US006224687B1

(12) United States Patent
Inoue

(10) Patent No.: US 6,224,687 B1
(45) Date of Patent: May 1, 2001

(54) PISTON RING MATERIAL AND PISTON RING WITH EXCELLENT SCUFFING RESISTANCE AND WORKABILITY

(75) Inventor: Kenichi Inoue, Narita (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 09/131,886

(22) Filed: Aug. 10, 1998

(30) Foreign Application Priority Data

Aug. 11, 1997 (JP) ..... 9-216064
Sep. 30, 1997 (JP) ..... 9-283062

(51) Int. Cl.[7] ..... C23C 8/26
(52) U.S. Cl. ..... 148/318; 148/325; 148/333; 420/34; 277/434; 277/443
(58) Field of Search ..... 148/318, 325, 148/333, 334; 420/34, 100, 101; 277/434, 443, 444

(56) References Cited

U.S. PATENT DOCUMENTS

| | | | | |
|---|---|---|---|---|
| 2,177,700 | * | 10/1939 | Fisher | 277/434 |
| 4,345,943 | | 8/1982 | Takahashi et al. | 75/238 |
| 4,738,730 | | 4/1988 | Ferguson et al. | 148/16.5 |
| 5,096,514 | * | 3/1992 | Watanabe et al. | 148/325 |
| 5,259,887 | * | 11/1993 | Takahashi et al. | 148/325 |
| 5,304,262 | * | 4/1994 | Karaoke et al. | 148/589 |
| 5,944,920 | * | 8/1999 | Fukushima | 148/325 |

FOREIGN PATENT DOCUMENTS

| | | | |
|---|---|---|---|
| 30 15 898 A1 | | 6/1980 | (DE) . |
| 0295111 | | 12/1988 | (EP) . |
| 0356615 | | 3/1990 | (EP) . |
| 0 799 902 A1 | | 8/1997 | (EP) . |
| 2248454 | | 4/1992 | (GB) . |
| 2254395 | | 10/1992 | (GB) . |
| 59-16653 | | 9/1984 | (JP) . |
| 63-14006 | | 1/1988 | (JP) . |
| 58-027860A | * | 2/1993 | (JP) . |
| 405248540A | * | 9/1993 | (JP) . |
| 8-109445 | | 4/1996 | (JP) . |

OTHER PUBLICATIONS

Patent Abstracts of Japan, C–895, Dec. 18, 1991, vol. 15/No. 500, "Wear Resistant Sliding Material and Its Manufacture", abstracting JP 3–219–050 A1.

* cited by examiner

*Primary Examiner*—John Sheehan
*Assistant Examiner*—Andrew L. Oltmans
(74) *Attorney, Agent, or Firm*—Sughrue, Mion, Zinn, Macpeak & Seas, PLLC

(57) ABSTRACT

The invention provides a piston ring and piston ring material with excellent properties since not only it has excellent properties as a piston ring, but also excellent in drawability and rolling workability in the manufacturing process of stock, very excellent bending workability can be attained even when relatively high hardness after heat treatment is established, and excellent in properties as a piston ring. The piston ring material essentially consists, by weight of 0.2 to 1.2% C, 5.0 to 25.0% Cr and the balance Fe and incidental impurities, $M_7C_3$ type carbide content existing in the structure being 4.0% or less in terms of area percent to attain excellent scuffing resistance and workability. Preferably, C is 0.2 to 0.7%, and Cr is not less than 5.0% but less than 12.0%. Cr (wt. %)/C (wt. %) is 12 to 45, preferably 15 to 45, more preferably 18 to 30. In addition, the piston ring material of the present invention may contain not more than 0.25% Si, not more than 0.30% Mn, at least one not more than 2.5% in total selected from the group consisting of Mo, W, V and Nb, not more than 4.0% Cu, not more than 2.0% Ni, not more than 1.5% Al.

20 Claims, 2 Drawing Sheets

PISTON RING MATERIAL AND PISTON RING WITH EXCELLENT SCUFFING RESISTANCE AND WORKABILITY

BACKGROUND OF THE INVENTION

The present invention relates to a piston ring material and a piston ring used in an internal combustion engine.

PRIOR ART

In recent years, the internal combustion engine has been provided with various improvements such as low fuel consumption design, high performance design, light weight design, exhaust gas-purifying design, and etc.

Among them, a piston ring, which is a sliding portion in the internal combustion engine, is strongly demanded for improvements in characteristics such as fatigue characteristic, wear resistance, and scuffing resistance because of thickness-thinning design as the engine has light weight design and high rotation design. Thus, a cast iron piston ring conventionally used is being replaced with a steel piston ring which is excellent in strength and fatigue characteristic.

At present, materials used for the steel piston ring mainly include material based on Si—Cr steel equivalent to JIS SWOSC-V, or martensite stainless steel containing 12–21% of Cr (hereinafter called "high-Cr martensite stainless steel").

Typically, a piston ring made of Si—Cr steel is Cr-plated on its surface for use. However, the Cr-plating layer formed on the piston ring surface has insufficient wear resistance required for use.

In addition, when it is applied to an internal combustion engine with high load, there arises a problem that ring matrix is exposed due to peeling of a plating area. Consequently, scuffing can immediately occur on the inner wall of the cylinder.

In addition, Cr-plating treatment involves various problems associated with waste liquid generated after the treatment and such as adverse effects on environment, or increase of waste liquid treatment cost in recent years.

On the other hand, many of the piston rings made of high Cr martensite stainless steel are treated for nitriding on its surface for use.

The nitride layer not only has higher wear resistance when compared with the Cr-plating layer, but also has no problem of peeling of the treated layer because the nitriding is treatment utilizing diffusion, so that it has very excellent characteristics for the piston ring.

In addition, since the nitriding is inexpensive in its treatment cost, and causes less impact on environment, it is a more advantageous treatment than the Cr-plating treatment.

Furthermore, even if it is necessary to provide he Cr-plating treatment depending on its application, high r martensite stainless steel can be also used as a piston ring material for Cr-plating because the material itself has higher heat resistance, wear resistance and corrosion resistance than Si—Cr steel.

As described above, the conventional piston ring has been used for a high load internal combustion engine relatively placing emphasis on performance, but its use is not limited to such high load internal combustion engine, and being gradually expanded for range in the background of demands for the recent internal combustion engine such as low fuel consumption design, high performance design, light weight design, exhaust gas-purifying design and etc.

SUMMARY OF THE INVENTION

Typically, in manufacturing the high Cr martensite stainless steel as the piston ring material, the material formed in a flat wire or a deformed wire stock is once heated to 900–1100° C., quenched and hardened, and then tempered at a relatively high temperature.

After the above heat treatment, the high Cr content martensite stainless steel stock would be formed into a predetermined ring shape. However, its hardness should be conditioned to as relatively low as 35–45 HRC when compared with the post-heat treatment hardness of 45–55 HRC of Si—Cr steel to increase the bending workability (curling property) in forming into the ring shape.

Higher heat treatment hardness is desirable if emphasis is essentially placed on wear resistance, scuffing resistance, and fatigue resistance as a piston ring.

However, the high Cr content martensite stainless steel containing much residual carbide has a problem that its heat treatment hardness should be conditioned to a lower level although its properties is more or less deteriorated because it may be broken during bending work if it has a high heat treatment hardness.

To reduce such problem, there is known a low alloy piston ring proposed in JP-A-59-166653 and JP-A-63-140066.

Such approach lowers Cr content to a low level of 2.0 to 9.0%. Although it can improve breakage resistance property, the scuffing resistance is significantly lowered. Thus, the composition proposed by the above has a problem in the properties as a piston ring, and it is the current status that it is not widely put in practical use.

In addition, since the high Cr martensite stainless steel has higher work hardening than the Si—Cr steel, work ratio cannot be increased until it is finished as a flat wire or deformed wire stock.

It calls for a large number of annealing stages during drawing or rolling process, so that there is a problem that cost for manufacturing wire stock becomes expensive.

Then, in view of the above, the present invention is intended to provide a piston ring material and a piston ring for which the manufacturing cost can be reduced by improving the warm or cold drawability and rolling workability, and the breakage during forming a ring can be reduced without deteriorating characteristics required for a piston ring.

First, the inventor thoroughly examined a wire-shaped piston ring stock after hot rolling for factors affecting its warm and cold drawability and rolling workability.

Furthermore, the inventor thoroughly studied bending workability after heat treatment of the stock, and scuffing resistance and wear, most important as piston ring, resistance for factors affecting its properties.

As the result, the inventor found that the properties largely depend on morphology of carbide existing in the structure of piston ring material, and found optimal morphology of carbide which provided very good workability even during manufacturing and after heat treatment without deteriorating the required wire stock properties as a piston ring.

In addition, the inventor found that conditioning of C and Cr contents as elements contained in the piston ring material is effective in further attaining the various properties described above, and in attaining the optimal carbide state, and reached the preset invention.

That is, the piston ring material according to the present invention essentially consists, by weight of 0.2 to 1.2% C, 5.0 to 25.0% Cr and the balance Fe and incidental impurities, $M_7C_3$ type carbide content existing in the structure being 4.0% or less in terms of area percent to attain excellent scuffing resistance and workability. Preferably, C is 0.2 to 0.7%, and Cr is not less than 5.0% but less than 12.0%.

With the piston ring material according to the present invention, it is possible to attain excellent scuffing resistance and workability even for a low Cr content martensite piston ring material which contains Cr of not less than 5.0% but less than 12.0%.

In addition, the piston ring material according to the present invention can attain very good workability even after heat treatment without deteriorating required properties as a piston ring by limiting Cr (wt. %)/C (wt. %) to 12–45. Preferably, Cr (wt. %)/C (wt. %) is 15–45, more preferably 18–30.

In addition to above, the piston ring material according to the present invention can further improve the properties required for the piston ring material by conditioning, by weight, Si to not more than 0.25%, Mn to not more than 0.30%, or one or more of Mo, W, V and Nb to not more than 2.5% in total. It is also possible to condition Cu to not more than 4.0%, Ni to not more than 2.0%, or Al to not more than 1.5%.

With the piston ring material with excellent bending workability according to the present invention, even when a wire stock to be bent is bend along a longer side of its small cross-section, breakage is difficult to occur regardless of hardness conditioning after its heat treatment. That is, the present invention can provide a piston ring with a shape difficult to be bent such as a ratio of length in a radial direction R to length in a center axis direction T, R/T, is not less than 1.5 in a cross section taken along a plane including the center axis.

Then, the piston ring formed with a nitride layer according to the present invention has excellent wear resistance.

PREFERRED EMBODIMENTS OF THE INVENTION

Figure 1:
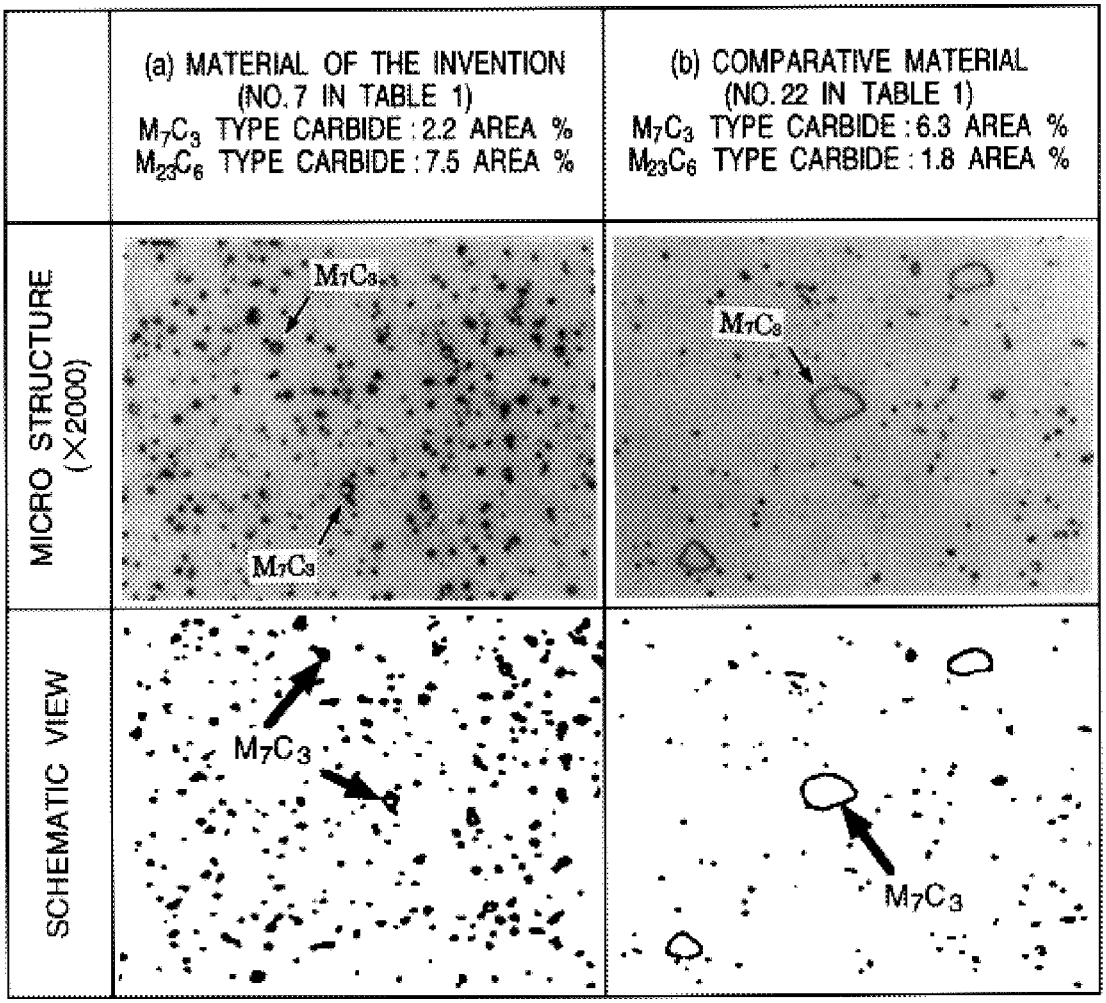
FIG. 1 is photographs of metal micro structure showing an example of carbide existing in a structure of piston ring material, and its schematic view.

A piston ring material of the present invention improves not only workability in manufacturing wire stock but also bending workability after heat treatment, as well as exhibits excellent scuffing resistance although it is of low alloy when compared with a conventional material.

One of the most significant features of the present invention is to condition content of C and Cr in steel and to properly condition morphology of carbide in the structure as means for attaining such excellent characteristics of the present invention.

Now, description is give n the above requirements which constitute the foundation of the present invention.

C is one of the important elements of the present invention which not only forms carbide to improve scuffing resistance and wear resistance, but also a part of C exists in solid-solution state in the matrix to contribute to improvement of strength and fatigue characteristic.

To attain such effect, C is required to be at least 0.2%. However, when its content exceeds 1.2%, it deteriorates warm or cold workability in manufacturing wire stock, and bending workability after heat treatment. Therefore, the present invention limited the C content to 0.2–1.2%. Preferably, it is 0.2–0.7% to further improve such workability.

Similar to C, Cr which is also one of important elements constituting the present invention forms carbide as it combines with C, so that it contributes to improve scuffing resistance and wear resistance, and also contributes improvement of thermal permanent strain resistance because it partially exist in a solid-solution state in the matrix to serve as a secondary hardening element in tempering.

In addition, since it forms minute nitride in a nitride layer through nitriding process, it is possible to further improve scuffing resistance and wear resistance of the piston ring.

To attain above effects, Cr is required to be at least 5.0%. However, if the content exceeds 25.0%, it causes increase of amount or grain size of carbide, so that workability is deteriorated, Thus, Cr in the present invention has content of 5.0–25.0%. Preferably, it is made not less than 5.0% but less than 12.0% to further improve such workability.

Then, in addition to the conditioning of contents of the above elements, it is most important for the present invention to condition, in terms of area percent, amount of $M_7C_3$ carbide existing in the structure to not more than 4.0%.

Workability and scuffing resistance required for the piston ring material depend on the Cr carbide as described above, and the inventor has found that the influence is closely related to difference of grain size and distribution of carbide, which difference is caused from difference of types of Cr residual carbide.

That is, scuffing resistance and workability of the piston ring material significantly differ in dependence on the type of Cr residual carbide, and the inventor discovered optimal morphology of carbide for improving such properties.

Now, detailed description is given carbide existing in the structure of piston ring material.

Two types of carbide, $M_7C_3$ and $M_{23}C_6$, are well known as Cr carbide existing in the piston ring material.

However, since $M_7C_3$ carbide is formed as primary carbide coarse in grain size when it is solidified, and relatively stable at high temperature, it is characterized in that it is difficult to condition morphology at the hot working temperature and heat treatment temperature.

On the other hand, although $M_{23}C_6$ is also Cr carbide, $M_{23}C_6$ carbide is characterized in that it is easily conditioned for its grain size and distribution with hot working temperature and heat treatment temperature.

Thus, for a material in which much $M_7C_3$ carbide exists, there arises microscopic difference in the structure after its hardening and tempering, that is, there occurs microscopic scuffing in areas where carbide sparsely exists, which areas are caused from the co-existence of both densely existing carbide and sparsely existing carbide, so that scuffing resistance is deteriorated.

In addition, if coarse $M_7C_3$ carbide is ununiformly distributed in the structure, not only scuffing resistance is significantly deteriorated, but also workability is significantly deteriorated.

In other words, if morphology of carbide can be made so that $M_7C_3$ is not extremely dominant, carbide becomes very fine after hardening and tempering, and can be very uniformly distributed, so that this carbide morphology make it possible to substantially suppress deterioration of scuffing resistance resulting from ununiform carbide distribution as above to occur.

In addition, less primary carbide coarse in grain size and fine carbide after hardening and tempering can make it possible to improve warm and cold workability in manufacturing the wire stock and bending workability after heat treatment even for high alloy stock of relatively hard workability. Thus, it also possible to improve production efficiency and to reduce manufacturing cost.

From the above, the inventor has discovered that that reduction of $M_7C_3$ carbide is most effective to improve various properties of piston ring material. It is very important as specific conditioning requirement in the piston ring material according to the present invention to condition, in terms of area percent, amount of $M_7C_3$ carbide existing in the structure to not more than 4.0%, preferably, to not more than 2.5%.

Here, the term "area percent" as used herein means the ratio of total sectional area of $M_7C_3$ carbide occupying the sectional area.

FIG. 1 shows an example of $M_7C_3$ carbide existing in the structure of piston ring material conditioned for hardening with hardening and tempering, and shows photographs of micro structure of $M_7C_3$ carbide the test piece of which is mirror grind, and etched $M_7C_3$ carbide in white and $M_{23}C_6$ carbide in black by using Murakami reagent, and observed by an optical microscope at a magnification of 2000, and its schematic view.

In FIG. 1(*a*), $M_7C_3$ carbide is 2.2% in terms of area percent, and satisfies the morphology of carbide in the present invention. That is, carbide dominant in this structure is $M_{23}C_6$ carbide as shown and in an effective morphology of carbide for obtaining the characteristics of the present invention.

On the other hand, in FIG. 1(*b*), $M_7C_3$ carbide is 6.3% in terms of area percent. It is recognized as shown in the figure that $M_7C_3$ carbide is very ununiformly distributed. That is, it is in morphology of carbide which is already difficult to obtain the characteristics of the present invention.

With the present invention described above, it is possible to improve scuffing resistance without sacrificing workability even for low alloy material with Cr content of not less than 5.0% but less than 12.0% which Cr content had been deemed, in prior art, not to satisfy sufficient scuffing resistance required in the piston ring although the workability is good. Thus, this respect is an approach to consistently attain both workability and scuffing resistance excellent for the piston ring material.

Then, with its excellent bending workability, it is possible to provide a piston ring with a shape difficult to be bent such as the ratio of radial length R to center axial length T, R/T, is not less than 1.5, or not less than 2.0, at a cross section of wire stock when it is cut along a plane containing the central axis.

Another feature of the present invention is to properly condition a value of Cr (wt. %)/C (wt. %) as means to attain such excellent characteristics of the present invention. Now, the above requirement is described in detail.

Scuffing resistance required for the piston ring depends on Cr carbide as described above. The inventor has discovered that the influence thereof is significantly related to the type of Cr residual carbide, as well as difference of grain size and distribution state of the Cr residual carbide resulting from difference of the types.

Then, further study also revealed that morphology of such Cr residual carbide can be controlled by conditioning content of C and Cr, and also by conditioning a content ratio of Cr to C.

Specifically, when Cr (wt. %)/C (wt. %) is not less than 12, $M_{23}C_6$ is the dominant Cr residual carbide.

$M_{23}C_6$ carbide is characterized in that its grain size and distribution can be easily controlled by hot working temperature and heat treatment conditions. That is, when the composition in which $M_{23}C_6$ is dominant is arranged, it is possible to obtain a structure in which the grain size and distribution of the residual carbide are very uniform. Thus, such a phenomenon as microscopic scuffing occurs in areas where carbide sparsely exists is hardly caused, which sparsely existing carbide are caused from the coexistence of both densely existing carbide portions and sparsely existing carbide portions. Accordingly, in the invention, the scuffing resistance of the material can be improved.

On the other hand, when Cr (wt. %)/C (wt. %) is less than 12, $M_7C_3$ is the dominant Cr residual carbide.

$M_7C_3$ carbide forms primary carbide coarse in grain size when it is solidified. Since such carbide is relatively stable at a high temperature, it is characterized in that morphology is difficult to be controlled by hot working temperature and heat treatment temperature than $M_{23}C_6$. Thus, distribution as described above occurs in carbide in the structure, leading to significant deterioration of scuffing resistance.

In addition, since, when the value of Cr (wt. %)/C (wt. %) exceeds 45, amount of residual carbide significantly decreases, not only wear resistance of the material itself is lowered, but also a nitride layer formed by nitriding becomes very fragile, so that it becomes a very risky material used for a piston ring.

According to the present invention, particularly when the value of Cr (wt. %)/C (wt. %) is conditioned to not less than 15, dominance of $M_{23}C_6$ carbide is further improved, while a content ratio of $M_7C_3$ carbide can be suppressed to a lower level. Then, even when the value of Cr (wt. %)/C (wt. %) is less than 15, if the value is not less than 12, it is possible to suppress a content ratio of $M_7C_3$ carbide to a sufficiently low level by performing soaking at not less than 1100° C., preferably, at 1100–1300° C. in its ingot state together with conditioning of content of Cr and C according to the present invention.

From the above, it is very important for the piston ring material according to the present invention to have the value of Cr (wt. %)/C (wt. %) of 12–45, preferably, 15–45, more preferably, to 18–30.

Now, there are described reasons of limitation and effect of preferable elements other than above for constituting the piston ring material according to the present invention.

Si is an element improving not only workability during manufacturing wire stock, which is one of the objects of the present invention, but also bending workability after heat treatment.

The inventor has found that inclusion of suitable amount of Si in steel exhibits a significant effect in attaining the object of the invention described above, and has determined that such effect becomes significant particularly when Si content becomes not more than 0.25%.

On the other hand, Si is an element residual in steel as a deoxidizing element in a refining process, and is said to be necessary to add at least 0.3% in a case of a low-to-middle Cr martensite stainless steel with Cr content of 2.0–9.0% represented by JP-A-61-59066 as an element for improving oxidation resistance and thermal permanent strain resistance.

However, oxidation resistance becomes not necessarily put importance because an actual piston ring is used in a lubricant, and used with some surface treatment such as nitriding or Cr plating.

In addition, the inventor performed detailed study on an action of Si added for improving the thermal permanent strain resistance.

That is, conventional addition of Si significantly delaying aggregation of carbide precipitated in tempering in a material tempered at a low temperature.

In other words, the inventor has found that, in a martensite piston ring generally tempered at 550–650° C. where most of precipitated carbide are deemed to be aggregated, other elements contributing to secondary hardening had more significant effects, and a significant effect could not be recognized regarding Si.

Because of recent advance of steel manufacturing technology, it is sufficiently possible to reduce oxide nonmetal inclusions even when amount of Si deoxidizing agent being used is decreased.

From the above, Si in the present invention is determined to be not more than 0.25% as a content for improving bending workability after heat treatment in addition to workability during manufacturing wire stock. A preferable range of Si is 0.05–0.20%.

As described, the present invention which properly conditions Si content can further improve workability in manufacturing wire stock and bending workability after heat treatment.

In particular, the improvement of bending workability after heat treatment by the present invention means that heat treatment hardness can be conditioned to a relatively higher level than in the conventional piston ring, so that it becomes possible to obtain a higher level of both scuffing resistance and wear resistance in comparison with prior arts where the improvement of these resistances had been restrained to enhance bending workability.

Mn is one of elements necessary for refining steel as a deoxidizing agent or a desulfurizing agent.

JP-A-61-59066 as described above describes that content of at least 0.5% is required for improving strength and hardness.

However, it was confirmed that, when more than 0.30% Mn is contained, it deteriorates workability in annealed state, although it is not so significant as in the reduction of Si content. Thus, in the present invention, Mn content is limited to not more than 0.30%.

Mo, W, V, and Nb are elements not only forming hard carbide as they themselves combine C, but also improve wear resistance since they partially exist in solid solution state in Cr carbide to strengthen Cr carbide itself.

In addition, since they contribute as secondary hardening element in tempering, they are also effective in improving thermal permanent strain resistance of a piston ring.

However, their excessive addition causes increase of hard carbide, which not only significantly increase amount of wear of a cylinder, but also causes deterioration of workability. Thus, in the present invention, one or more of Mo, W, V, and Nb are limited to not more than 2.5% in total, preferably to 0.3–2.5%.

Cu contributes to enhancement of matrix and improvement of thermal permanent strain resistance as it forms minute solid solution in Fe and matrix without forming carbide or nitride, so that it can be added, as required.

However, since, when its content exceeds 4.0%, hot workability is extremely deteriorated, its upper limit is determined to be 4.0%. Then, according to the present invention, preferable Cu content is 0.5–3.0%.

Ni is not necessarily added. However, in a case where a piston ring is apt to be exposed to impact strain during the use thereof, it may be allowed to add Ni, as required, to improve the toughness.

However, since, when more than 2.0% Ni is added, it significantly deteriorates workability in annealed state, its upper limit is determined to be 2.0%.

Al may be added, as required, because it forms AlN with N which penetrates during nitriding, so that it contributes to increase hardness of the nitriding layer, and to improve wear resistance of a piston ring.

However, if its content exceeds 1.5%, not only workability and fatigue characteristic are extremely deteriorated, but also hard AlN precipitated through nitrization extremely increases, so that amount of wear extremely increases on the cylinder. Thus, addition of Al is limited to not more than 1.5%, and preferably to 0.2–0.6%.

In addition to the elements described above, the piston ring material of the present invention may be added with Ti and Mg to increase hardness of the nitride layer, or Co which is effective in improving corrosion resistance, as required.

EXAMPLES

Now, advantages of the present invention will be described with reference to examples.

First, 30 kg ingot was produced which was conditioned to predetermined composition by high frequency induction melting in the air. Then, the ingot was formed into wire stock with 8 mm diameter through hot working, and annealed at 860° C. Resultant composition of the annealed material is shown in Table 1.

TABLE 1

| | Chemical components (wt %) | | | | | | | | | | | | $M_7C_3$ | Cr/C | |
|---|---|---|---|---|---|---|---|---|---|---|---|---|---|---|---|
| No. | C | Si | Mn | Ni | Cr | W | Mo | V | Nb | Cu | Al | Fe | (area %) | (wt % ratio) | Category |
| 1 | 0.29 | 0.24 | 0.29 | — | 5.6 | — | 1.24 | 0.50 | — | 2.10 | — | Bal | 0.5 | 19.3 | Material |
| 2 | 0.32 | 0.32 | 0.46 | — | 5.6 | — | 1.45 | 0.80 | — | — | 0.42 | Bal | 0.6 | 17.5 | according |
| 3 | 0.25 | 0.20 | 0.21 | — | 7.3 | — | 1.33 | 0.10 | — | 0.66 | — | Bal | 0.2 | 29.2 | to the |
| 4 | 0.32 | 0.23 | 0.33 | 0.30 | 8.8 | — | — | — | — | — | 0.39 | Bal | 1.4 | 27.5 | invention |
| 5 | 0.45 | 0.20 | 0.25 | 0.91 | 8.8 | 0.65 | — | — | 0.20 | — | — | Bal | 2.5 | 19.6 | |
| 6 | 0.55 | 0.40 | 0.53 | — | 10.3 | — | — | — | — | — | 0.21 | Bal | 2.4 | 18.7 | |
| 7 | 0.50 | 0.20 | 0.28 | — | 10.5 | — | — | — | — | — | — | Bal | 2.2 | 21.0 | |

TABLE 1-continued

| No. | Chemical components (wt %) C | Si | Mn | Ni | Cr | W | Mo | V | Nb | Cu | Al | Fe | $M_7C_3$ (area %) | Cr/C (wt % ratio) | Category |
|---|---|---|---|---|---|---|---|---|---|---|---|---|---|---|---|
| 8 | 0.42 | 0.12 | 0.31 | — | 11.3 | — | 1.12 | — | — | — | — | Bal | 1.1 | 26.9 | |
| 9 | 0.66 | 0.19 | 0.22 | — | 11.2 | 0.85 | — | 0.85 | 0.10 | — | 0.32 | Bal | 2.5 | 17.0 | |
| 10 | 0.31 | 0.18 | 0.24 | 0.31 | 11.6 | — | 0.33 | 0.21 | 0.32 | — | — | Bal | 0.2 | 37.4 | |
| 11 | 0.64 | 0.40 | 0.32 | — | 12.9 | — | 0.31 | — | — | — | 0.21 | Bal | 1.3 | 20.2 | |
| 12 | 0.39 | 0.41 | 0.29 | — | 13.3 | — | 0.25 | 0.23 | — | — | — | Bal | 0 | 34.1 | |
| 13 | 0.66 | 0.30 | 0.70 | 0.31 | 13.2 | 0.65 | — | — | — | — | — | Bal | 1.3 | 20.0 | |
| 14 | 0.67 | 0.20 | 0.25 | — | 13.4 | — | 0.42 | 0.21 | — | — | — | Bal | 1.2 | 20.0 | |
| 15 | 0.86 | 0.42 | 0.33 | — | 17.3 | — | 1.03 | 0.11 | — | — | — | Bal | 1.3 | 20.1 | |
| 16 | 0.76 | 0.19 | 0.25 | — | 17.7 | 0.65 | — | 0.51 | — | 2.25 | — | Bal | 1.2 | 23.3 | |
| 17 | 0.85 | 0.21 | 0.31 | 0.15 | 17.4 | — | 0.85 | 0.21 | 0.11 | — | 0.15 | Bal | 1.2 | 20.5 | |
| 18 | 0.92 | 0.12 | 0.35 | — | 20.8 | — | 1.12 | 0.11 | 0.13 | — | — | Bal | 0.8 | 22.6 | |
| 19 | 0.72 | 0.20 | 0.25 | — | 21.2 | — | 1.00 | 0.15 | — | 2.03 | — | Bal | 0.6 | 29.4 | |
| 20 | 0.83 | 0.15 | 0.22 | — | 21.3 | — | 1.03 | 0.31 | — | — | 0.13 | Bal | 0.7 | 25.7 | |
| 21 | 0.61 | 0.15 | 0.21 | — | 8.2 | — | — | — | — | — | — | Bal | 5.6 | 13.4 | Comparative material |
| 22 | 0.82 | 0.22 | 0.31 | — | 10.2 | — | 0.30 | 0.11 | — | — | — | Bal | 6.3 | 12.4 | |
| 23 | 1.05 | 0.19 | 0.22 | — | 13.2 | — | 0.31 | — | 0.12 | — | — | Bal | 13.1 | 12.6 | |
| 24 | 1.42 | 0.25 | 0.21 | — | 13.3 | — | 0.36 | — | — | — | — | Bal | 18.2 | 9.4 | |
| 25 | 1.41 | 0.25 | 0.32 | — | 17.3 | — | 1.02 | 0.15 | — | — | — | Bal | 20.3 | 12.3 | |
| 26 | 2.01 | 0.19 | 0.31 | — | 17.0 | — | 1.12 | — | 0.31 | — | — | Bal | 23.2 | 8.5 | |

Then, parts of the resultant annealed material were worked into tension test pieces with a diameter of 6 mm at the parallel section of 40 mm long, and subjected to a tension test for evaluating drawing and rolling workability of the wire stock. At the same time, their hardness was also measured.

Remaining annealed materials were drawn at room temperature until they became wire stock with 5.5 mm diameter. Then, they were conditioned for its hardness through hardening at 1050° C. followed by tempering. Hardness after the conditioning was 48–50 HRC for the present invention materials Nos. 1–10 and for comparative materials Nos. 21 and 22, and 38–40 HRC for the remaining present invention materials and comparative materials.

Then, bending test pieces with a sectional shape of 3 mm×3 mm were produced from these heat treated materials conditioned for hardness, and a bending resistance test was conducted.

Subsequently, for the present invention and comparative materials, respective evaluation test pieces were sampled from the heat treated materials for confirming comparative merits and demerits of characteristics of the nitride layer formed on them. They were then subjected to gas nitriding at 520° for 10 hours assuming actual nitriding normally provided for a piston ring worked into a predetermined shape after the heat treatment.

Figure 2:
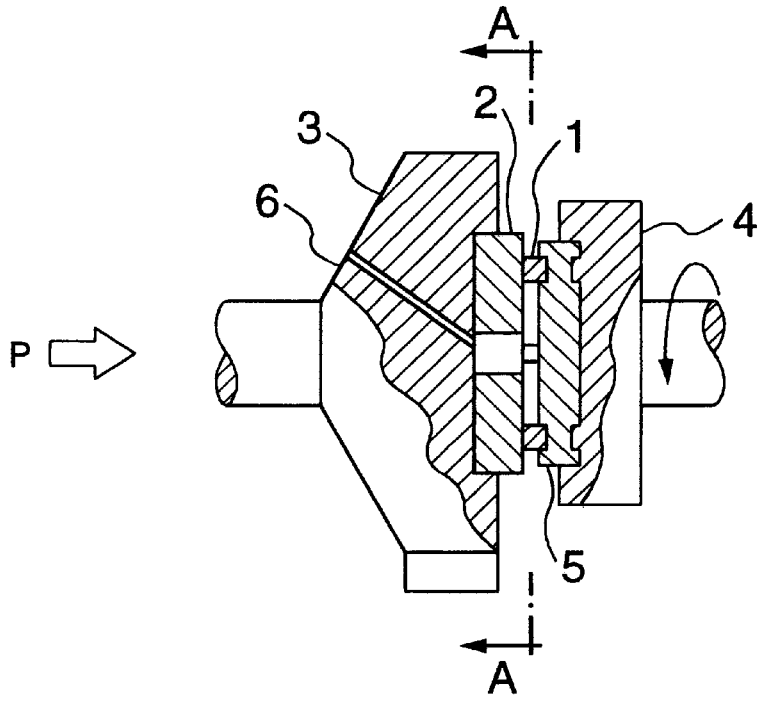
FIG. 2 is a sectional view of a test piece on a very high pressure friction wear test machine.
Figure 3:
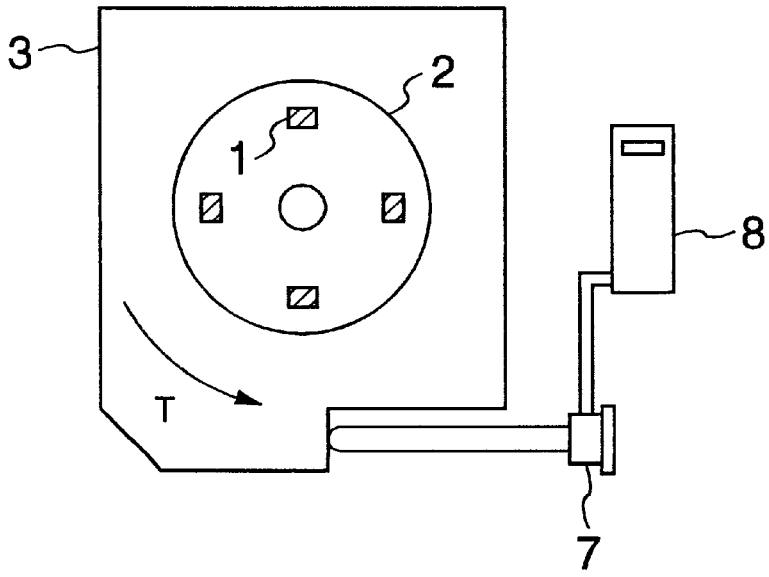
FIG. 3 is a sectional view taken along line A—A of FIG. 2.

Thereafter, the surface of test piece was grind off by 10–15 $\mu$m for removing a fragile nitride layer formed on the outermost surface. Then, the test piece was measured for hardness of the outermost surface of the nitride layer, and subjected to the scuffing resistance test. The scuffing resistance test was performed under the following conditions using a very high pressure friction wear test machine, and evaluated at seizure load. Overview of the test piece mount of the test machine is shown in FIGS. 2 and 3.

Friction velocity . . . 8 m/s

Friction surface pressure . . . initial pressure: 20 kgf/cm$^2$, increased by 10 kgf/cm$^2$ in every three minutes Lubricating oil . . . motor oil #30, oil temperature 80° C., supplied from the center of stator holder at 400 ml/min.

Seizure detection . . . detecting with a load cell and a dynamic strain gauge

Counter material . . . JIS gray cast iron (FC 250)

Table 2 shows the test results.

TABLE 2

| No. | Characteristic of annealed material (drawability and rolling workability) Hardness (HV) | Tensile strength (N/mm$^2$) | Elongation (%) | Reduction of area (%) | Characteristic of heat treated material (bending workability) Hardness (HRC) | Deflection (mm) | characteristic after nitriding (properties as piston ring) Surface hardness (HV) | Scuff surface pressure (kgf/cm$^2$) | Category |
|---|---|---|---|---|---|---|---|---|---|
| 1 | 141 | 526 | 32.3 | 76.3 | 48.2 | 10.3 | 1005 | 100 | Material according to the invention |
| 2 | 222 | 761 | 32.2 | 73.5 | 48.6 | 10.2 | 1139 | 100 | |
| 3 | 134 | 472 | 36.5 | 79.4 | 48.1 | Not broken | 1001 | 105 | |
| 4 | 144 | 538 | 32.1 | 75.4 | 48.1 | Not broken | 1136 | 105 | |

TABLE 2-continued

| No. | Characteristic of annealed material (drawability and rolling workability) Hardness (HV) | Tensile strength ($N/mm^2$) | Elongation (%) | Reduction of area (%) | Characteristic of heat treated material (bending workability) Hardness (HRC) | Deflection (mm) | characteristic after nitriding (properties as piston ring) Surface hardness (HV) | Scuff surface pressure ($kgf/cm^2$) | Category |
|---|---|---|---|---|---|---|---|---|---|
| 5 | 148 | 562 | 34.7 | 78.2 | 48.5 | Not broken | 983 | 105 | |
| 6 | 180 | 620 | 32.1 | 71.5 | 49.2 | 10.6 | 1162 | 105 | |
| 7 | 154 | 571 | 33.2 | 74.6 | 49.3 | 11.8 | 1012 | 105 | |
| 8 | 149 | 564 | 31.7 | 75.9 | 48.8 | 11.9 | 1031 | 105 | |
| 9 | 162 | 578 | 31.7 | 71.3 | 49.8 | 10.7 | 1180 | 105 | |
| 10 | 145 | 559 | 32.1 | 75.4 | 48.2 | Not broken | 1042 | 105 | |
| 11 | 190 | 650 | 27.7 | 60.9 | 39.6 | 10.9 | 1132 | 105 | |
| 12 | 185 | 644 | 32.0 | 68.3 | 40.5 | Not broken | 1102 | 105 | |
| 13 | 189 | 647 | 28.1 | 59.1 | 40.2 | 10.8 | 1050 | 105 | |
| 14 | 188 | 646 | 30.1 | 61.2 | 40.3 | 11.1 | 1055 | 105 | |
| 15 | 243 | 798 | 25.5 | 41.1 | 38.7 | 7.9 | 1140 | 115 | |
| 16 | 238 | 786 | 25.7 | 40.3 | 38.6 | 7.7 | 1145 | 115 | |
| 17 | 220 | 751 | 29.2 | 45.2 | 38.8 | 8.3 | 1233 | 115 | |
| 18 | 255 | 823 | 22.6 | 33.4 | 38.4 | 4.3 | 1170 | 120 | |
| 19 | 261 | 840 | 21.7 | 32.9 | 38.6 | 4.5 | 1184 | 120 | |
| 20 | 253 | 827 | 22.1 | 34.5 | 38.3 | 4.6 | 1256 | 115 | |
| 21 | 169 | 590 | 32.5 | 71.2 | 49.6 | 10.6 | 902 | 80 | Comparative material |
| 22 | 203 | 740 | 29.8 | 63.6 | 49.3 | 7.4 | 981 | 85 | |
| 23 | 212 | 740 | 29.2 | 36.6 | 40.2 | 4.5 | 1098 | 90 | |
| 24 | 220 | 748 | 26.5 | 31.3 | 39.6 | 2.7 | 1105 | 85 | |
| 25 | 274 | 875 | 19.6 | 28.5 | 38.4 | 1.3 | 1132 | 115 | |
| 26 | 284 | 893 | 16.7 | 20.2 | 38.2 | 0.2 | 1150 | 120 | |

From Table 2, it can be found that the present invention materials has a reduction of area value after annealing larger than that of the comparative material with the same Cr content, and is very good in cold workability.

In addition, it is also found that, for amount of deflection after heat treatment, the present invention materials show a higher value than the comparative materials. That is, with the present invention material, even when hardness after heat treatment is conditioned to a relatively higher level, breakage is hard to occur during bending working, so that it is also advantageous in improving scuffing resistance and wear resistance with high hardness conditioning.

Now, result of evaluation is described for the characteristics after nitriding, or characteristics required for the piston ring itself being actually used.

Hardness of the surface-nitriding layer of the present invention material is substantially equal to the conventional material, so that sufficient wear resistance for a piston ring can be attained.

In addition, the present invention material shows a high scuff surface pressure value in the scuffing test, so that it is found to have very good scuffing resistance as a piston ring.

In particular, although the present invention materials Nos. 1–10 is relatively low alloy as a piston ring material because its Cr content is as low as less than 12%, it is found that they are significantly improved for scuffing resistance when compared with the conventional materials Nos. 21 and 22 by properly conditioning $M_7C_3$ carbide to a suitable amount.

This demonstrates that the present invention is also effective for improving properties of the "piston ring material containing Cr of not less than 5.0% but less than 12.0%, which Cr content had been deemed, in prior art, not to satisfy required characteristics" as described above.

The comparative materials Nos. 25 and 26 have good scuffing resistance although they contain amount of $M_7C_3$ carbide in their structure exceeding the present invention.

This is deemed to occur from the content of $M_7C_3$ carbide far exceeding the mound limited in by the present invention and from the extreme increase of their grain size.

However, since, as described above, the extreme increase of $M_7C_3$ carbide significantly deteriorate workability of the stock, the comparative materials Nos. 25 and 26 is found to be inferior in their deflection.

If it is intended to simply improve scuffing resistance of stock, it may be sufficient to increase amount and grain size of carbide in the structure. However, such approach provides too low workability as a piston ring material, so that cold bending work performed in manufacturing of current piston ring becomes impossible to be performed.

In addition, since the comparative materials Nos. 23 and 24 are observed to show deterioration of bending workability due to increase of their carbide content, it is appreciated that conditioning of carbide according to the present invention is effective for attaining improvement in both workability and scuffing resistance.

Furthermore, while the comparative materials Nos. 21 and 22 surely satisfy content of C and Cr of the present invention, it is difficult to perform sufficient conditioning of carbide to improve scuffing resistance since they contain amount of $M_7C_3$ carbide exceeding the present invention.

According to the present invention, it is possible to inexpensively provide a piston ring material with excellent properties since not only it has excellent properties as a piston ring, but also excellent in drawability and rolling workability in the manufacturing process of the stock, and very excellent bending workability can be attained even when relatively high hardness after heat treatment is established.

Then, in addition to provision of excellent wear resistance through formation of nitride layer on its surface, the present invention can provide a piston ring with a shape difficult for bending workability.

Thus, the present invention has very high industrial advantages such as improvement of production efficiency and reduction of production cost.

What is claimed is:

1. A piston ring material with excellent scuffing resistance and workability consisting essentially, by weight, of 0.2 to 0.7% C, 5.0 to 25.0% Cr and the balance Fe and incidental impurities, and having a $M_7C_3$ carbide content in the structure of not more than 4.0% in terms of area percent.

2. The piston ring material with excellent scuffing resistance and workability as set forth in claim 1, wherein Cr is, by weight, not less than 5.0% but less than 12.0%.

3. The piston ring material with excellent scuffing resistance and workability as set forth in claim 1, wherein Cr (wt. %)/C (wt. %) is 12 to 45.

4. The piston ring material with excellent scuffing resistance and workability as set forth in claim 1, wherein Cr (wt. %)/C (wt. %) is 15 to 45.

5. The piston ring material according to claim 1, wherein the $M_7C_3$ carbide content in the structure is not more than 2.5% in terms of area percent.

6. The piston ring material according to claim 1, wherein Cr (wt %)/C (wt %) is 18 to 30.

7. The piston ring material with excellent scuffing resistance and workability as set forth in any one of claims 1, and 2 through 4, wherein the piston ring material consists essentially, by weight, of 0.2 to 0.7% C, not less than 5.0% but less than 12.0% Cr, not more than 0.25% Si, not more than 0.30% Mn, at least one not more than 2.5% in total selected from the group consisting of Mo, W, V and Nb, not more than 4.0% Cu, not more than 2.0% Ni, not more than 1.5% Al and the balance Fe and incidental impurities.

8. The piston ring material with excellent scuffing resistance and workability as set forth in claim 1, wherein the piston ring material consists essentially, by weight, of 0.2 to 0.7% C, not less than 5.0% but less than 12.0% Cr, not more than 0.25% Si, not more than 0.30% Mn, at least one not more than 2.5% in total selected from the group consisting of Mo, W, V and Nb, not more than 4.0% Cu, not more than 2.0% Ni, not more than 1.5% Al and the balance Fe and incidental impurities, Cr (wt. %)/C (wt. %) being 18 to 30, and having a $M_7C_3$ type carbide content existing in the structure of not more than 4.0% in terms of area percent.

9. The piston ring material according to claim 8, wherein the $M_7C_3$ carbide content in the structure is not more than 2.5% in terms of area percent.

10. A piston ring formed by bending a wire stock, consisting essentially, by weight, of 0.2 to 0.7% C, 5.0 to 25.0% Cr and the balance Fe and incidental impurities, and having a $M_7C_3$ carbide content existing in the structure of 4.0% or less in terms of area percent.

11. The piston ring as set forth in claim 10, wherein said piston ring has a center axis, and an arbitrary cross section of the piston ring, which cross section is defined when cutting the piston ring by a plane that includes therein the center axis of the piston ring, has a radial length R and an axial length L, and the ratio R/L is not less than 1.5.

12. The piston ring as set forth in claim 10, wherein the piston ring contains a surface-nitriding layer on a surface of the piston ring.

13. The piston ring as set forth in claim 10, wherein Cr is, by weight, not less than 5.0% but less than 12.0%.

14. The piston ring as set forth in claim 10, wherein Cr (wt. %)/C (wt. %) is 12 to 45.

15. The piston ring as set forth in claim 10, wherein Cr (wt. %)/C (wt. %) is 15 to 45.

16. The piston ring as set forth in any one of claims 8, 11, 12, and 13 through 14, wherein the piston ring consists essentially, by weight, of 0.2 to 0.7% C, not less than 5.0% but less than 12.0% Cr, not more than 0.25% Si, not more than 0.30% Mn, at least one not more than 2.5% in total selected from the group consisting of Mo, W, V and Nb, not more than 4.0% Cu, not more than 2.0% Ni, not more than 1.5% Al and the balance Fe and incidental impurities.

17. The piston ring as set forth in claim 10, wherein the piston ring contains a surface-nitriding layer on a surface of the piston ring, and the piston ring has a center axis, and an arbitrary cross section of the piston ring, which cross section is defined when cutting the piston ring by a plane that includes therein the center axis of the piston ring, has a radial length R and an axial length L, and the ratio R/L is, not less than 1.5, said piston ring consisting essentially, by weight, of 0.2 to 0.7% C, not less than 5.0% but less than 12.0% Cr, not more than 0.25% in total selected from the group consisting of Mo, W, V and Nb, not more than 4.0% Cu, not more than 2.0% Ni, not more than 2.0% Ni, not more than 1.5% Al and the balance Fe and incidental impurities, Cr (wt. %)/C (wt. %) being 18 to 30, and having a $M_7C_3$ carbide content existing in the structure of 4.0% or less in terms of area percent.

18. The piston ring according to claim 10, wherein the $M_7C_3$ carbide content in the structure is not more than 2.5% in terms of area percent.

19. The piston ring according to claim 10, wherein Cr (wt %)/C (wt %) is 18 to 30.

20. The piston ring according to claim 17, wherein the $M_7C_3$ carbide content in the structure is not more than 2.5% in terms of area percent.

* * * * *